United States Patent [19]

Bals

[11] Patent Number: 4,502,634

[45] Date of Patent: Mar. 5, 1985

[54] ROTARY ATOMIZING SPRAYER

[76] Inventor: Edward J. Bals, Delamere House, Tedstone Delamere, Bromyard, Herefordshire HR7 4PS, England

[21] Appl. No.: 489,088

[22] Filed: Apr. 27, 1983

[30] Foreign Application Priority Data

Apr. 28, 1982 [GB] United Kingdom ..... 8212333

[51] Int. Cl.[3] ..... B05B 3/10

[52] U.S. Cl. ..... 239/223

[58] Field of Search ..... 239/223, 224, 700–703

[56] References Cited

U.S. PATENT DOCUMENTS 1,640,418 8/1927 Marr ..... 239/223

3,221,992 12/1965 Sedlacsik, Jr. et al. ..... 239/703

FOREIGN PATENT DOCUMENTS 2026904A 2/1980 United Kingdom .

2004204B 2/1982 United Kingdom .

*Primary Examiner*—Andres Kashnikow

*Attorney, Agent, or Firm*—Staas & Halsey

[57] ABSTRACT

A sprayer, particularly for use in agricultural crop-spraying, has a rotary atomizer comprising a rotary frusto-conical part, a slotted cylindrical liquid distribution member fixed centrally in the rotary part, and a liquid distributor of frusto-conical form but inverted relative to the rotary part. The distributor is fixed to the slotted liquid distribution member, surrounding and substantially enclosing it. The rotary part is arranged to rotate in bearings in a bearing housing in a fixed part of the sprayer and a stationary liquid feed tube supplies liquid to the member. The interior surface of the distributor is smooth and the interior surface of the rotary part is grooved. In use, the rotary part is caused to rotate by the rotation of a turbine and liquid supplied to the member is ejected by centrifugal force through the slots onto the smooth interior surface of the distributor at or near the smaller diameter portion thereof. The liquid then flows over the smooth surface and leaves a peripheral edge of the distributor to be distributed into the grooves in the surface of the rotary part. The grooves form reservoirs for the liquid to ensure even distribution of liquid around the rotary part and even spray distribution with uniformity of droplet size.

8 Claims, 2 Drawing Figures

ROTARY ATOMIZING SPRAYER

BACKGROUND OF THE INVENTION

This invention relates to sprayers having rotary atomizers and has particular, though not exclusive, application to agricultural crop-spraying equipment.

Liquid sprays are applied to crops and agricultural land for a variety of reasons but a principal use is for the application of pesticides, which may be herbicides, insecticides or fungicides. For efficient use of these relatively costly materials it is important that the droplets in the spray are of a size suitable for the application and ideally the droplets should be of uniform size.

The significance of control of droplet size is that, if they are too large they will not provide even coverage over foliage or other surfaces to be sprayed and they will also fall to the ground too quickly. Also an excessive quantity of liquid tends to be expanded. On the other hand if the droplet size is too small, the droplets will be too easily carried on the wind and again even distribution on the surface to be sprayed is impaired. There is therefore an optimum range whereby even distribution and minimum liquid material consumption is obtained this being usually in the range of 20–500 microns in diameter.

Conventional pressure atomizer sprayers are not capable of giving small, uniform size droplets, so rotary atomizers having discs or hollow cones are preferred. Liquid is fed to the centre of the atomizer disc or cone and rotation results in migration of the liquid to the periphery from which it is discharged as a series of droplets. The atomizer disc or cone advantageously has a serrated perimeter so that the liquid is dicharged from a series of points of small dimensions and there may be radial grooves to feed the liquid to these points. Such a design is based on the observation that the best results in terms of droplet size and uniformity, are obtained if the liquid issues from the points as discrete filaments which are broken up into droplets after leaving the atomizer.

In order to obtain even spray distribution from a rotary atomizer it is necessary to supply liquid to the rotary part disc or cone in such a manner that the distribution around the periphery, from which the liquid leaves the atomizer, is an uniform as possible. One arragement is to provide a hollow shaft through which the liquid is discharged through a radial opening onto the adjacent rotating surface of the rotary part, but thhis can lead to uneven supply to the inner portion of the rotary part and therefore similarly uneven distribution at the periphery.

SUMMARY OF THE INVENTION

It is therefore the object of this invention to provide a sprayer of the kind having a rotary atomizer in which the supply of liquid to the surface of a rotary part of the atomizer is performed in a particularly efficient manner, enabling even spray distribution to be obtained, and uniformity of droplet size to be achieved.

According to the present invention there is provided a sprayer having a rotary atomizer including a circular periphery rotary part, to a surface of which the liquid to be sprayed is supplied at a circular region disposed inwardly of the periphery of the part. The means for supplying liquid to the rotary part comprises an apertured rotary member, to the interior of which liquid is supplied, when in use, and a rotary distributor surrounding the said apertured rotary member, having an circular surface of divergent form onto which liquid is deposited from the apertured rotary member. The apertured rotary member has an outer peripheral edge disposed adjacent to and radially inwardly of the circular surface of the rotary distributor.

Preferably the rotary part has a frusto-conical surface which is provided with grooves leading towards the peripheral edge.

The arrangement in use is such that liquid is fed to the interior of the apertured rotary member and is discharged therethrough onto the surrounding rotary distributor surface and flows outwardly on this surface, in the form of an even film due to the centrifugal force, to be distributed evenly into the grooves on the circular region of the rotary part and then flows along the grooves towards the peripheral edge, at which it is discharged in droplet form.

The invention will now be described by way of example, with reference to the accompanying drawings.

DESCRIPTION OF THE PREFERRED EMBODIMENTS

Figure 1:
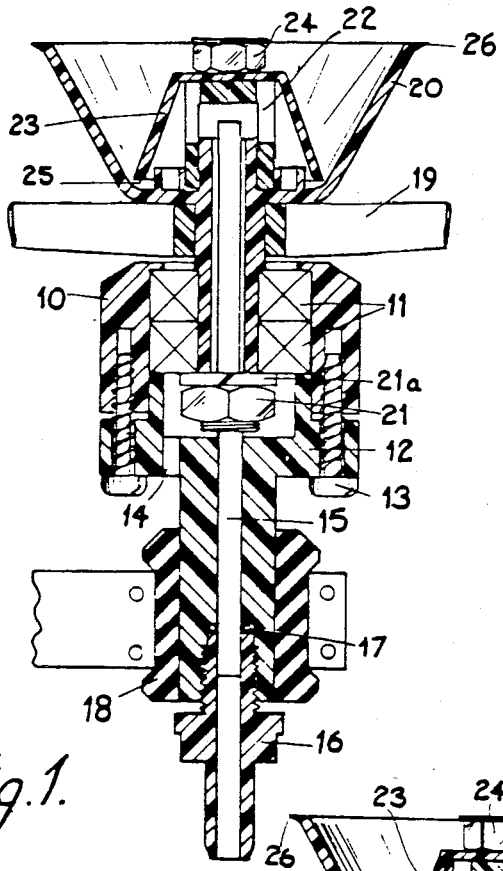
FIG. 1 is a cross-sectional view of a sprayer with a rotary atomizer constructed in accordance with the invention.

With reference to FIG. 1, there is shown a sprayer having fixed and rotatable parts. The fixed parts include a bearing housing and mounting assembly and these are mounted on an appropriate structure such as a boom and there is a supply of liquid to be sprayed which may reach the sprayer through flexible piping. The sprayer is suitable for use singly or in multiples for agricultural crop spraying and has been designed to provide distribution of liquid in droplet form wherein the droplet size is as uniform as possible.

The rotary atomizer part is preferably rotated at very high speed for example of the order of 20,000 rpm and this enables the liquid to be discharged in droplet size of the order of 35 to 40 microns. The direction of spray is normally either horizontal or vertical, for example, for spraying trees, but in some circumstances downward spray is required and the sprayer illustrated is intended for use in any orientation.

FIG. 1 shows the sprayer having stationary parts including a bearing housing 10 of cup-shape in which is a pair of contacting bearings 11 are provided, each bearing having respective inner and outer races. These bearings are held in place by a member 12 secured by screws 13. The member 12 includes a tubular spigot portion which engages inside the bearing housing 10 and locates against the outer race of one of the bearings 11. In this way the bearings are located axially. The bearings are a press fit in the housing 10 so as to prevent outer race rotation.

The member 12 has a series of holes 14 which open into the interior of the bearing housing. In use, a negative pressure is created at the upper open end of an inner tube 15 and this causes air to flow through the holes 14, to assist the prevention of liquid flowing back down the shaft to the ball bearing as well as permitting drainage of excess liquid, as will later be described.

The member 12 has a cylindrical extension which has a small central bore containing the inner tube 15. At its end remote from the bearing housing 10 this extension is threaded to receive an adaptor 16 for connection to a flexible pipe (not shown) through a conventional fir tree type connection.

The adaptor 16 encloses the end of the inner tube 15 and this is sealed in the extension of the member 12 by means of an O-ring 17 which is trapped between the end of the adaptor 16 and a shoulder in the extension of the member 12. In trapping the O-ring, it is firmly pressed against the inner tube and thus acts in the manner to create a seal.

Surrounding the cylindrical extension of the member 12 is a vibration damping rubber mounting spool 18 whereby the whole assembly can be mounted on the boom or other structure.

The rotary atomizer portion of the sprayer includes a turbine 19 with three blades, although other numbers of blades can be used. This is mounted on a rotary part 20 which is of frusto-conical form with a spigot extending from its narrower end. The spigot, which is hollow, is threaded at its end and receives a nut 21 and a lock washer 21*a*, whereby the spigot is secured in the inner race of the bearings 11. The internal bore of the spigot of the rotary part 20 is of a size larger than the inner tube 15 of the stationary part of the sprayer so that there is a clearance around the tube which extends right through the spigot. The spigot extends into the interior of the cup-shape formed by the frusto-conical part and the inner tube extends a short distance beyond this.

Tightly frictionally or otherwise engaged over this portion of the spigot of the part 20 is an apertured rotary member 22, which thus rotates with the rotary part 20. This is in the form of a small closed ended cylindrical component with radial slots in its wall. The slots may however be replaced by a series of equally spaced slots, holes or other shaped apertures. The slots extend from the closed end of the component to terminate substantially at the end of the spigot of the part 20, as shown in FIG. 1.

Surrounding and substantially enclosing the apertured rotary member 22 is a rotary distributor 23. This is in the form of a frusto-conical cup which is inverted with respect to the larger frusto-conical cup formed by the rotary part 20. To retain the rotary distributor 23 with its closed narrower end resting on the top of the apertured rotary member 22, a nut 24 is engaged on a threaded portion (not shown) formed integrally on the end of the apertured rotary member 22. Thus the distributor 23 rotates with the member 22 and also with the rotary part 20.

The interior surface of the rotary distributor 23 is smooth to allow the formation of a liquid film of even thickness due to centrifugal force but is outwardly divergent and terminates in a circular relatively fine peripheral edge 25, which is disposed close to, but spaced from the interior surface of the rotary part 20.

The interior surface of the rotary part 20 is, like that of the distributor, outwardly divergent, but is of course of opposite slope. This internal surface is grooved (although not shown in the drawing) and the grooves extend substantially in radial planes as described in U.K. Published Patent Specification No. 2026904A. The grooves terminate at the peripheral edge 26 of the rotary part 20 in a series of teeth or points. The grooves are aligned with the respective points and there are, in a typical example, 360 grooves and corresponding teeth. The tooth form may however be asymmetrical as shown and described in the Specification of U.K. Pat. No. 2004204B. Except for the inner tube 15 and the bearings and screws, the parts may conveniently be made from plastics materials.

In use, liquid is supplied under pressure through the adaptor 16 and into the inner tube 15. From the end of the stationary inner tube, the liquid is ejected by centrifugal force from the interior of the apertured rotary member 22 and is expelled through the slots to be deposited on the interior frusto-conical surface of the rotary distributor 23 at or near the smaller diameter portion thereof.

The liquid flows over this smooth interior surface under the action of centrifugal force and leaves the peripheral edge 25 of the rotary distributor, to be distributed on to the internal frusto-conical surface of the rotary part 20. The liquid is distributed onto a circular region of the rotary part surface, at which the grooves start and which is radially outwardly of the peripheral edge 25 of the rotary distributor 23.

The liquid now flows along the respective grooves towards the peripheral edge of the rotary part 20 and leaves from the respective points 26 as a series of droplets. The grooves form respective reservoirs for the liquid in that the radial outward flow of the liquid is restricted by the forces acting on it which are centrifugal and rotational. This arrangement ensures even distribution of the liquid around the rotary part 20 so that spray discharge is evenly distributed.

The use of the rotary distributor 23 provides a particularly efficient manner of distributing the liquid onto the surface of the rotary part 20 and it is possible to provide adequate coverage of crop with minimum liquid usage.

Since the droplets leaving the rotary atomiser have little inertia shortly after leaving the points at the peripheral edge 26, it is therefore convenient to mount the atomiser in the outlet of a blower device such as found on a conventional airblast sprayer used in orchards and vineyards or in an aeroplane boom, where the airstream is created by forward travel.

The blades of the turbine 19 are profiled to enable them, in a stream of air from a blower or the airflow existing by virtue of the forward movement of the boom, to rotate the rotary part of the sprayer and it is possible to provide variable pitch blades whereby the speed can be regulated.

The holes 14 in the member 12 of the stationary part of the sprayer provided for an inflow of air which can enter the interior of the apertured rotary member 22, as a result of the negative pressure at the open end of the tube 15, as already described.

When the device is at rest liquid can sometimes flow between the inner tube 15 and the spigot formed integrally with the rotary part 20 and in order to protect the bearings 11 such liquid can escape through the holes 14. Thus if the sprayer is in the position shown in the drawings with the rotary part 20 uppermost any such liquid will flow straight out through the holes 14. If on the other hand, the sprayer is in the opposite position with the rotary part 20 downwards there will be no tendency for the liquid to flow into the bearing housing 10. Similarly the sideways orientation liquid will be allowed to flow out through the holes 14.

By holding the outer race of the bearings 11 stationary and rotating the inner race the tendency for dirt to collect in the outer race is minimized.

Figure 2:
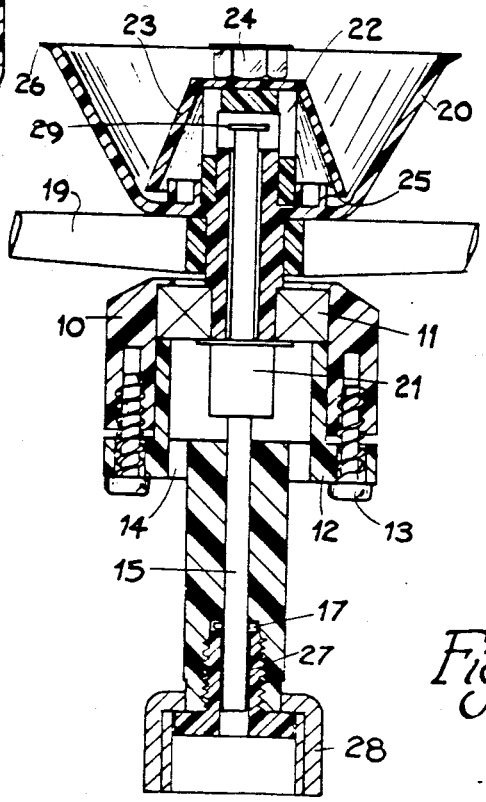
FIG. 2 is a cross-sectional view of a similar sprayer with an alternative connector.

In the version shown in FIG. 2 most of the parts are the same as those in the FIG. 1 construction except that the mounting arrangement differs. The mounting spool 18 is omitted and in place of the adaptor 16 there is an alternative adaptor 27 with an end flange which engages with a union nut 28. Other mounting arrangements can be adopted as required. In addition, only one bearing 11 is shown.

In this example the inner tube 15 has at its end a small disc 29 which prevents liquid from flowing through the clearance between the inner tube 15 and the spigot of the rotary part 20 and may also assist in the even discharge of the liquid from the apertured rotary member 22 which surrounds it.

I claim:

1. A rotary atomizing sprayer, comprising:

a rotary part, formed as a cup having a base, an internal surface, a peripheral edge at its open end and a hollow spigot extending through the center of the base, the spigot having an open end terminating in the interior of said rotary part and the interior surface of the rotary part having a plurality of grooves;

an apertured rotary member, provided on said open end of said spigot, having an interior portion in communication with said open end of said spigot and a closed end;

a liquid supply tube, extending through said spigot, having first and second ends, said first end being located within said interior portion of said apertured rotary member;

a rotary distributor secured to the closed end of and surrounding the apertured rotary member, having a divergent circular internal surface; and a rotor member provided on the portion of the hollow spigot extending from the exterior of the rotary part, so that a rotation of the rotor member causes a rotation of the spigot and thus the rotary part, the apertured rotary member and the rotary distributor, and so that liquid supplied from the supply tube passes through the apertures of the apertured rotary member to the internal surface of the rotary distributor then to the internal surface of the rotary part and subsequently flows along the grooves in the rotary part to the peripheral edge of the rotary part where it is discharged.

2. A sprayer according to claim 1, wherein said rotary distributor has a frusto-conical shape with the base at the narrower end and the circular peripheral edge at the wider end, and the interior surface of the rotary distributor is smooth.

3. A sprayer according to claim 2, wherein the rotary part has a frusto-conical shape which is inverted with respect to the rotary distributor, said rotary part has a circular region juxtaposed with respect to said peripheral edge of the rotary distributor, and said circular region is disposed adjacent to said base of the rotary part so that the fluid passes from the peripheral edge of the rotary distributor to the circular region of the rotary part.

4. A sprayer according to claim 3, wherein said grooves in the internal surface of said rotary part extend from said circular region to terminating points at said peripheral edge.

5. A sprayer according to claim 4, further comprising a plurality of teeth formed along the peripheral edge at the terminating points of said grooves.

6. A sprayer according to claim 1, wherein said rotary member is formed as a hollow cylinder having a cylindrical surface and a multiplicity of equi-spaced radial slots in substantially the entire cylindrical surface.

7. A sprayer according to claim 1, further comprising a fixed portion including a bearing housing and at least one bearing including a rotatable inner race and a relatively fixed outer race, wherein each bearing is disposed in the bearing housing and wherein externally of said cup, the hollow spigot is secured to the inner race of said at least one bearing.

8. A sprayer according to claim 7, wherein said liquid supply tube extends through said hollow spigot with a clearance therearound, said hollow spigot disposed externally of said cup terminates in said bearing housing and at least one aperture is provided in a wall of the bearing housing to allow any liquid flowing into said bearing housing by way of said clearance to escape therefrom.

* * * * *